US005206965A

United States Patent [19]

Rowley

[11] Patent Number: 5,206,965

[45] Date of Patent: May 4, 1993

[54] UTILITY KNIFE

[76] Inventor: Mark Rowley, 1740 E. Shaleh Meadows Rd. #9B, Holladay, Utah 84117

[21] Appl. No.: 797,422

[22] Filed: Nov. 22, 1991

[51] Int. Cl.[5] ..... B25G 1/10; B26B 1/08

[52] U.S. Cl. ..... 7/119; 30/125; 30/329

[58] Field of Search ..... 30/125, 162, 329, 335, 30/336; 7/119

[56] References Cited

U.S. PATENT DOCUMENTS

| | | | |
|---|---|---|---|
| 786,646 | 4/1905 | Johnson . | |
| 1,218,798 | 3/1917 | Nelson . | |
| 1,684,566 | 9/1928 | Winkler . | |
| 1,843,535 | 2/1932 | Arnold . | |
| 2,023,408 | 12/1935 | Coll . | |
| 2,023,409 | 12/1935 | Coll . | |
| 2,211,577 | 8/1940 | Muserlian . | |
| 2,688,187 | 9/1954 | Pauli | 30/289 |
| 2,952,025 | 9/1960 | Johnson . | |
| 4,255,856 | 3/1981 | Mackie | 30/293 |
| 4,974,320 | 12/1990 | Pelletier | 30/162 |
| 4,993,093 | 2/1991 | Goldwitz | 7/163 |

FOREIGN PATENT DOCUMENTS

| | | | |
|---|---|---|---|
| 90256 | 10/1983 | European Pat. Off. | 30/335 |

*Primary Examiner*—Douglas O. Watts
*Attorney, Agent, or Firm*—Trask, Britt & Rossa

[57] ABSTRACT

Cutting structure for scoring or cutting surfaces is disclosed. The cutting structure includes a housing having elongated sides, a blade and thumb positioning structure associated with the elongated sides. Measurement means may be positioned against the thumb positioning structure and may be held in place by the user's thumb thus providing a measured distance which may be cut. The invention further includes angled structure associated with the housing which provides a guiding surface when making angled or mitered cuts along the edge of drywall. The invention may also include a retractable measuring structure retained within the housing, a retractable blade, retaining means formed in the housing for housing spare blades and a notch for cutting rope and the like.

13 Claims, 4 Drawing Sheets

UTILITY KNIFE

BACKGROUND

1.

Field of the Invention

This invention relates generally to hand-held cutting implements. Specifically, this invention relates to cutting implements used for making measured scoring lines or cuts in linear surfaces, such cutting implements being structured to facilitate unencumbered and accurate scoring or cutting.

2. State of the Art

Cutting implements generally comprising a hand-held housing with a shortened blade positioned at one end of the housing are well-known. See, for example, U.S. Pat. No. 1,843,535 to Arnold issued Feb. 2, 1932. Cutting implements of this type may be adapted for specialized use in scoring or cutting various surfaces, such as cardboard boxes. Such cutting implements are typically known in the art as utility knives and may include retractable means for securing the blade within the housing to prevent accidental encounter with the blade.

Another common use of utility knives is in handling and customizing building materials for construction purposes. Specifically, utility knives are frequently used to score, cut and trim sheets of drywall and the like for use in constructing walls and ceilings. When so used, as in other similar applications, a score line or cut must be made along a length of board at an equal distance from the raw edge of the board. Measuring means are used to calculate the desired distance to be cut from the edge of the board, then the blade of the knife is moved along the surface of the board along a demarcated or imagined line corresponding to the desired distance to be cut.

Most frequently, a tape measure is used to measure the distance for cutting or scoring. Those in the art, wishing to simplify or facilitate the measurement aspect of cutting with utility knives, have developed utility knives having measuring means associated therewith. See, for example, U.S. Pat. No. 2,952,025 to Johnson issued Sep. 13, 1960. Though providing a ready source for measuring, such utility knives have proven cumbersome and inaccurate.

Most often, a separate tape measure is used. The housing of the knife is held in the hand while the metal tab of the tape measure is held against the blade with the thumb. The housing of the tape measure is held in the other hand and the fingers are used to retain the tape measure at a point on the tape corresponding to the desired length to be cut. Beginning at the top of the board and with the blade of the knife poised over the surface, both hands are moved downwardly. The hand with the tape measure is kept close to the edge of the board while the hand holding the knife urges the blade into the surface and holds the tape taut against the blade.

Problems are frequently encountered in measuring and cutting in the manner previously described, including slippage of the blade and inaccurate cutting or scoring. Others in the art, having recognized these problems, have attempted to address some of them through modified designs. For example, U.S. Pat. No. 4,255,856 to Mackie, issued Mar. 17, 1981, describes a utility knife having a plate positionable against the blade of the knife, the plate having a slot therein for retaining the metal tab of a tape measure. U.S. Pat. No. 4,993,093 to Goldwitz, issued Feb. 19, 1991, provides a utility knife housing having a slot formed in the upper surface thereof to retain the metal tab of a tape measure.

The previously identified utility knives each have inherent problems which present dangerous conditions for cutting, or result in inaccurate cutting. Specifically, extra plates positioned near the blade result in interference between the cutting blade and the surface to be cut. Further, such blades do not provide ready use by both right-handed and left-handed or ambidextrous persons. Slots formed in the upper surface of the knife require awkward positioning of the thumb or digits to hold the tab of the tape measure in secure engagement with the slot and result in the tape measure being positioned with the numerals away from the user.

Thus, it would be an improvement in the art to provide cutting means for scoring and cutting surfaces which, when used in connection with measuring means, provide unencumbered and accurate cutting. Additionally, it would be an improvement in the art to provide measuring structure in combination with a utility knife which provides convenient and accurate measurement.

A further problem encountered by persons using utility knives in construction work is that the knife is used to trim the edges of drywall or the like to make a mitered edge having a forty-five degree angle. The mitered or beveled edges of two sheets are then joined together to form a corner, as in a room. Conventional utility knives provide no guideline for making a precise forty-five degree angle. Thus, construction workers must "eye" the edge of the sheet and estimate an approximate forty-five degree angle. Inaccurate angles lead either to repeated trimming until the correct angle is achieved or patching the corner once the two edges are joined to hide the improperly cut angle.

Thus, it would be an improvement in the art to provide a utility knife which is configured to provide guidance for making accurate forty-five degree trimming of edges to achieve precisely mitered corners in drywall construction or the like.

SUMMARY OF THE INVENTION

A utility knife for scoring and cutting surfaces is provided which has thumb positioning structure to retain a portion of a measuring device thereagainst to aid in accurate measurement and unencumbered cutting or scoring of a surface. The utility knife of the present invention may further be provided with angled means for producing a 45° mitered or beveled cut on the edge of a sheet of drywall or the like. The utility knife of the present invention may further include measuring means associated therewith for convenient measurement.

The present invention generally includes a housing which is sized to be held comfortably and conveniently in the hand. A metal blade having at least one sharpened edge extends from one end of the housing. The blade may be retractable within the housing of the invention.

The housing is configured with a thumb positioning structure against which the user may rest the thumb of the hand. The thumb positioning structure provides an upstanding linear surface against which a portion of a measuring means may be positioned and held in place by the thumb. The thumb positioning structure is located relative to the housing at a distance from the blade, and is configured to prevent accidental slippage of the thumb in the direction of the blade.

The thumb positioning structure is also configured so that the measuring means is angled, relative to the housing, to allow easy viewing of the measurement numerals. The housing of the invention is preferably configured with a thumb positioning structure on both sides thereof so that the knife may be used by both right-handed persons and left-handed persons, or ambidextrous individuals.

The end of the housing from which the blade projects is preferably angled away from the lateral axis of the blade at a 45° angle. The angled end of the housing provides a guide by which the raw end of a piece of drywall, or similar construction material, may be beveled or mitered. Sheets of board thus mitered may then be joined at the trimmed edges to form a precise corner. Other angles (i.e., greater or less than forty-five degrees) may be provided to guide the trimming or cutting of other angles. An example of such trimming may be the reduction of an end of drywall to register against a door frame.

In an alternative embodiment, the invention may include a retractable tape measure retained within the housing in transverse orientation thereto which is withdrawn from a slot associated with the thumb positioning structure. The invention may also include a notch formed in the housing which exposes a portion of a blade. The notch may thus be used to trim rope or similar materials.

BRIEF DESCRIPTION OF THE DRAWINGS

In the drawings, which illustrate what is currently considered to be the best mode for carrying out the invention.

DETAILED DESCRIPTION OF THE ILLUSTRATED EMBODIMENTS

Figure 1:
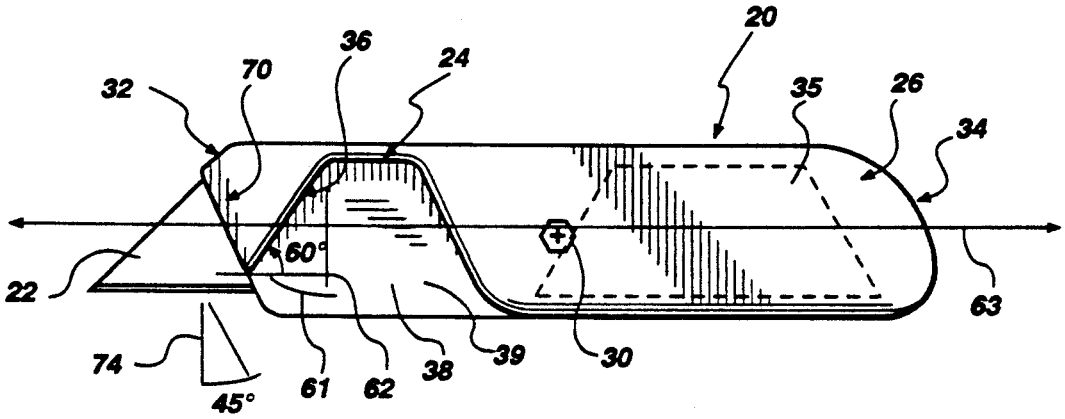
FIG. 1 is a side elevational view showing the left side of an embodiment of the invention with some elements being shown in phantom.
Figure 2:
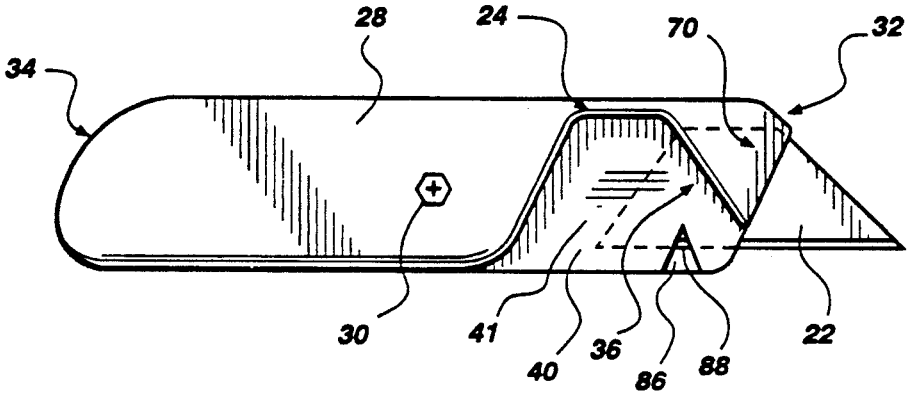
FIG. 2 is a side elevational view showing the right side of the embodiment shown in FIG. 1 with some elements being shown in phantom.
Figure 3:
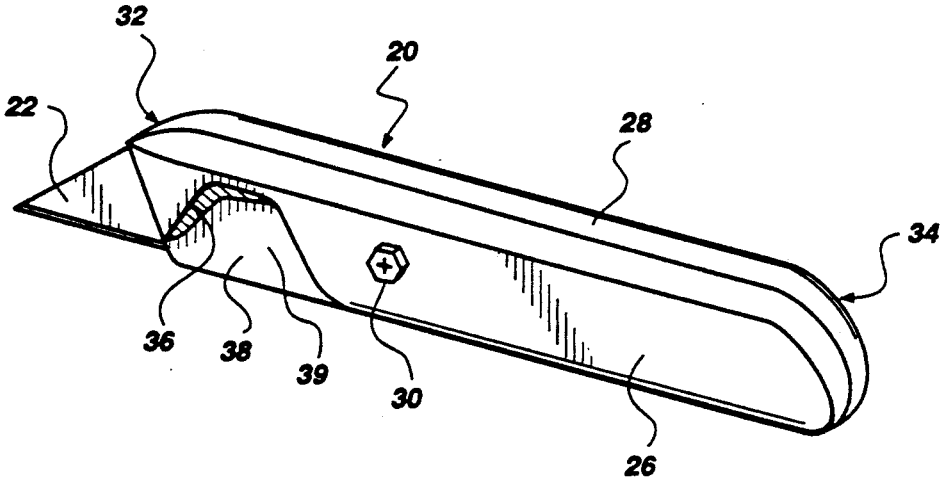
FIG. 3 is a perspective view showing the left side of the embodiment shown in FIG. 1.

FIGS. 1-7 generally illustrate the features of the present invention. Reference is made specifically to FIGS. 1-3 illustrating the invention which includes a housing 20, having a blade 22 positioned at one end thereof, and thumb positioning structure 24 associated therewith.

The housing 20 may typically be comprised of two laterally elongated sides 26 and 28 which are held together by securement means 30, such as a screw. Alternatively, the housing may be made in one piece. The housing may be said to have a forward end 32 and a rearward end 34. The forward ends of the sides 26 and 28 are typically formed to provide a slot 46 (shown in FIG. 5) through which the blade 22 projects. The blade 22 may be secured within the slot so as to be permanently extended. Alternatively, the blade 22 may be retractable within the housing. The rearward end 34 of the housing may also be adapted to retain extra blades therein, as suggested in FIG. 1 at 35.

The housing has a thumb positioning structure 24 associated therewith against which the user may inherently position or rest a thumb while gripping the housing in the hand, The thumb positioning structure 24 generally provides a linear surface 36 against which the thumb is positioned, and against which a portion of a measuring means (see FIG. 8) may be positioned. The thumb positioning structure 24 is generally located at some distance away from the blade 22 so that the thumb may not accidentally slip forward and contact the blade 22.

As illustrated in FIGS. 1-3, a particularly suitable thumb positioning structure 24 is provided by recesses 38 and 40 being formed in either side 26 and 28 of the housing. The recesses 38 and 40 comprise a flat surface 34, 41 and may be sized to approximately accommodate the end of the thumb, from the tip to the first joint thereof. The surface 36 at the forward end of the recess may be sized to accommodate the tip of the thumb thereagainst. A recess is preferably formed on either side 26 or 28 of the housing to allow for right- and left-handed use.

Figure 4:
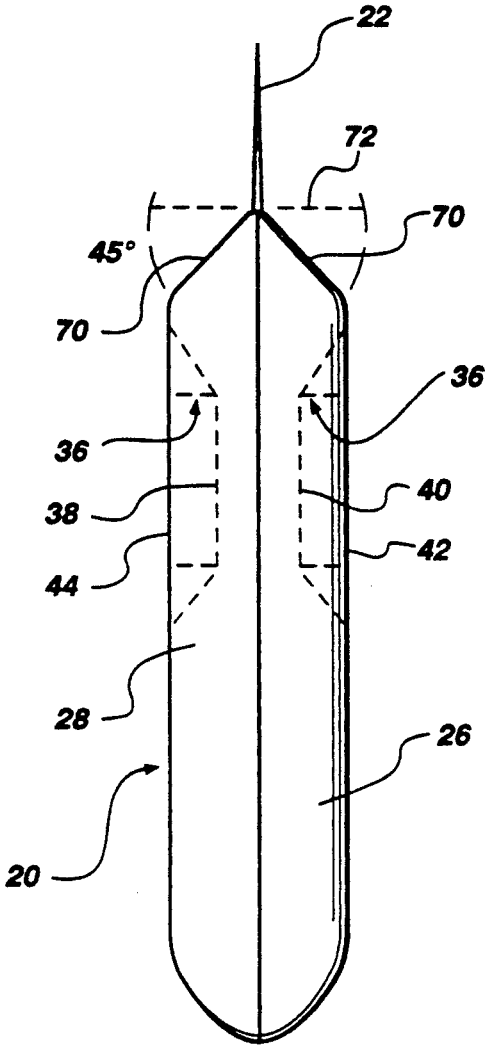
FIG. 4 is a plan view of the embodiment shown in FIG. 1, some detail being shown in phantom line.

Referencing FIG. 4, which illustrates the top view of the invention, the recesses 38 and 40, shown in phantom line, extend inwardly from the outer faces 42 and 44 of the sides 26 and 28, respectively, of the housing 20. It may be seen that the surfaces 36 at the forward end of each recess 38 and 40 provide a flattened area against which the measurement means (not shown) may be positioned, held in place by the thumb, as described further below.

Figure 5:
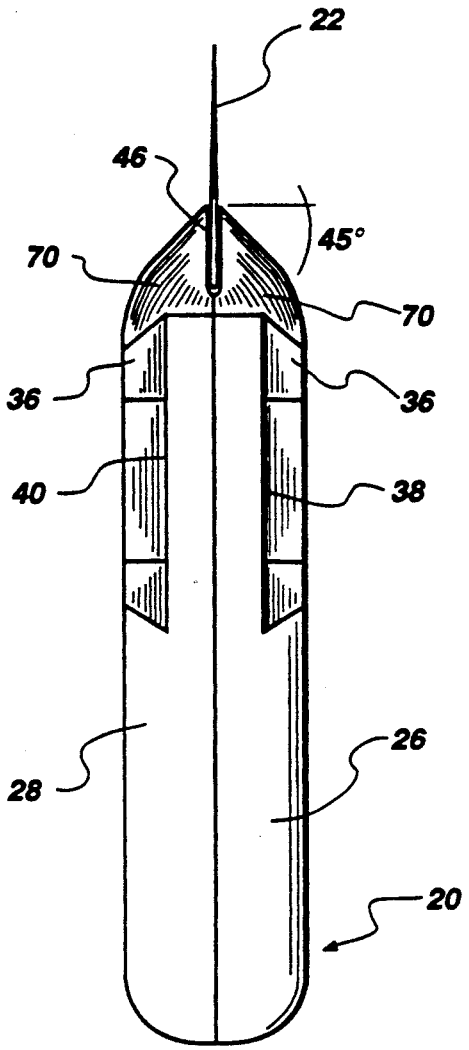
FIG. 5 is a bottom view of the embodiment shown in FIG. 1.
Figure 6:
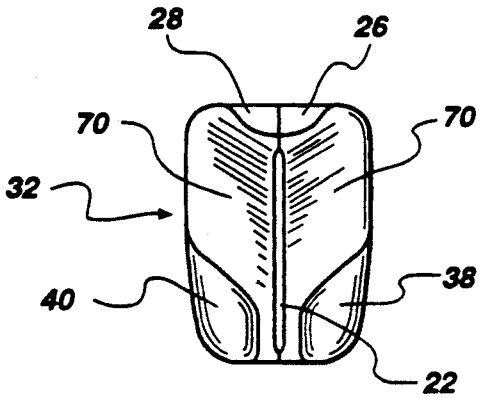
FIG. 6 is a front elevational view of the embodiment shown in FIG. 1.
Figure 7:
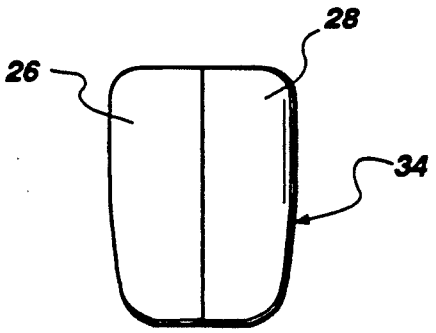
FIG. 7 is a rear elevation view of the embodiment shown in FIG. 1.

FIG. 5, illustrating a bottom view of the invention, may further assist in understanding the positioning of the recesses 38 and 40 and surfaces 36. FIG. 5 also illustrates the slot 46 formed at the forward ends of the sides 26 and 28 through which the blade 22 projects. FIG. 6 illustrates the forward end 32 of the invention, and FIG. 7 illustrates the rearward end 34 of the invention.

Figure 8:
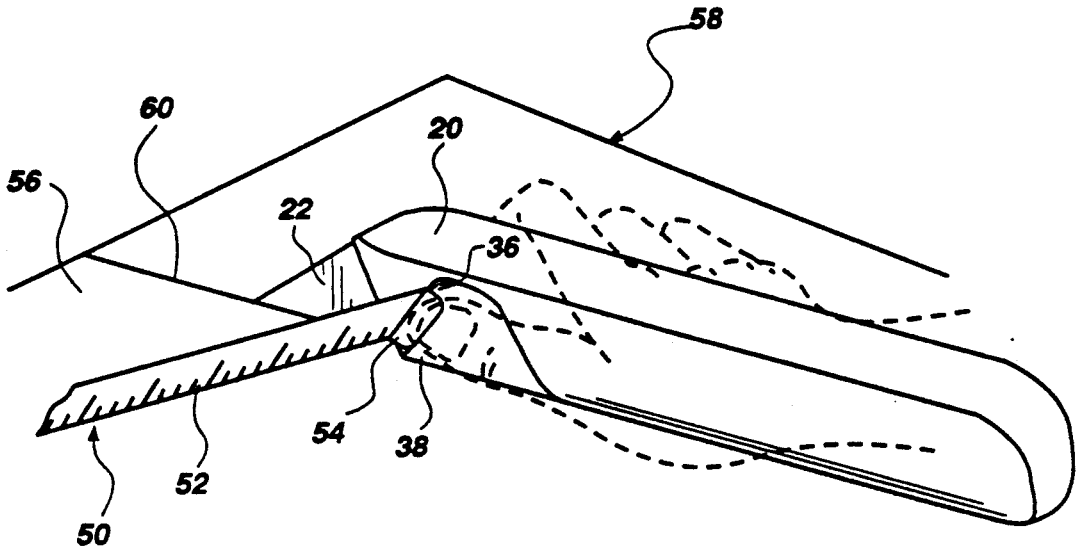
FIG. 8 is a perspective view illustrating use of the invention for scoring.

FIG. 8 provides an illustration of how the invention may be used in scoring or cutting a surface. That is, the user grasps the housing 20 of the invention with the blade 22 pointing away from the user. The thumb is cradled in the corresponding recess 38 (i.e., for right-handed use), and the fingers of the hand encircle the housing 20 in opposition to the placement of the thumb. Measuring means 50, such as a tape measure 52 having a metal tab 54 formed at the free end thereof, may be used with the invention. That is, the tab 54 of the tape measure 52 is held within the recess 38 and against the surface 36 by application of thumb pressure. The other end (not shown) of the tape measure is held with the other hand (not shown).

With the tape measure held taut between the right and left hands, the blade 22 is positioned on the surface 56 of a board 58. Both hands are drawn toward the user's body. The hand holding the tape measure is moved consistently along the edge of the board 58 while hand holding the housing 20 and tab 54 of the tape measure 52 draws the blade 22 along the surface 56 of the board 58 producing a score line 60 or cut. Circular scoring or cuts may also be produced by maintaining the hand holding the tape measure at a constant focus while the hand holding the housing 20 pivots about the other hand.

Notably, the angle 61 of the surface 36, as shown in FIG. 1, is such that when the blade 22 is positioned to cut, the housing 20 is rotated away from the user's body and the numerals of the measuring means 50 are more readily visible to the user. A particularly suitable angle 61 for surface 36 is about 30° relative to the vertical axis 62 of the housing 20, or about 60° relative to a longitudinal axis 63. The angle 61 of the surface 36 positions the measuring means 50 so that the opposing end held by the user's other hand does not catch on the raw edge of the drywall.

Figure 10:
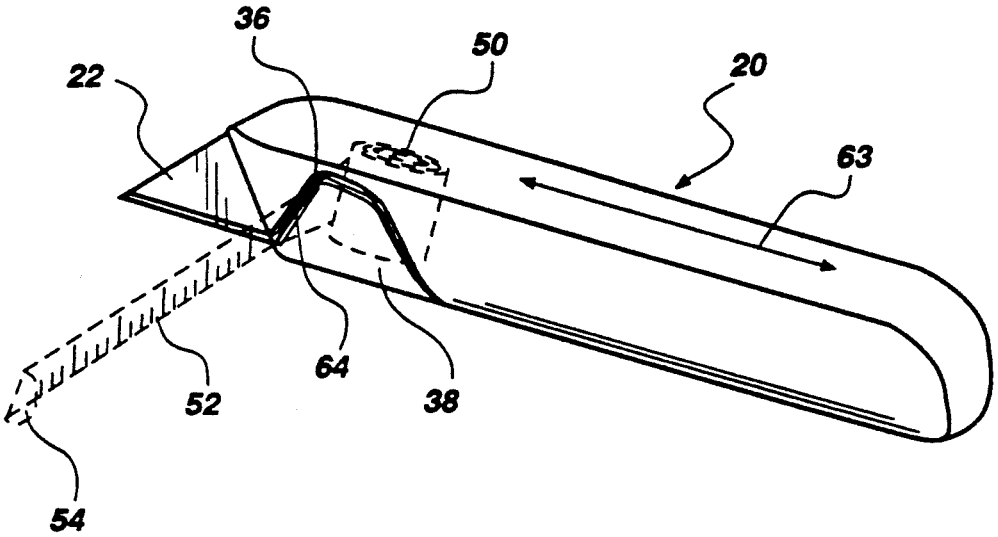
FIG. 10 is a perspective view of an alternative embodiment of the invention, some detail being shown in phantom line.

In an alternative embodiment, illustrated by FIG. 10, the housing 20 of the invention may be adapted to retain measuring means 50 within the housing 20. That is, a flexible, retractable tape measure 52 may be positioned within the housing 20 in transverse orientation to the longitudinal axis 63 of the housing 20. The metal tab 54 of the tape measure 52 may extend outwardly from a slot 64 positioned adjacent the surface 36 of the recess 38. Thus, when measuring a surface for scoring or cutting, the user may grasp the metal tab 54 and pull the measuring tape 52 outwardly from the housing 20 through the slot 64. When the desired length of tape measure 52 has been withdrawn from the housing, the user may position a thumb against the surface 36 of the recess 38 and secure the tape measure 52 in place by applying thumb pressure thereto. While holding the tape measure 52 taut, the score line or cut can be made as described above.

The housing 20 of the present invention includes angled structure 70 by which mitered cuts may be made. Referencing FIGS. 4, 5, 6 and 9, the forward ends of the sides 26 and 28 of the housing 20 slope backwardly from the blade 22 at a 45° angle to the transverse axis 72 of the blade. Further, the angled structure 70 slopes rearwardly from the forward end 32 of the housing 20 at a 45° angle to the vertical axis 74 of the housing 20, as shown in FIG. 1. The angled structure 70 provides a guiding surface for making angled cuts.

Figure 9:
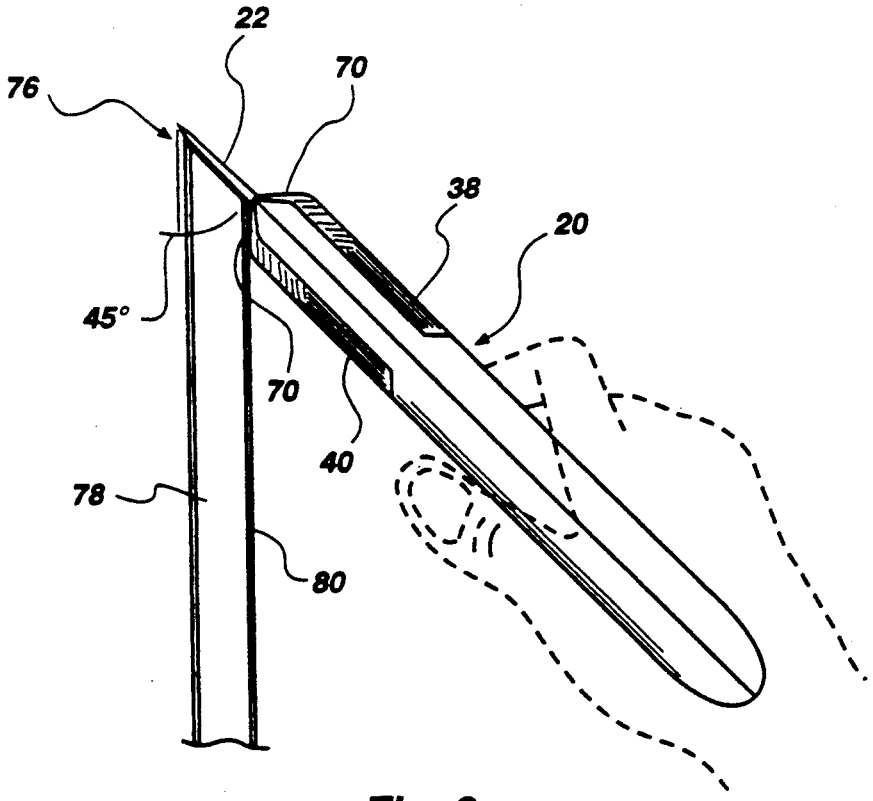
FIG. 9 is a perspective view illustrating use of the invention for mitering.

Thus, when a beveled or mitered edge needs to be made at the raw end 76 of a piece of drywall 78 or similar material, as illustrated by FIG. 9, the angled structure 70 is positioned against the flat surface 80 of the drywall 78 and the blade 22 is drawn along the edge 76 of the drywall. A precise 45° angle cut is achieved as long as the angled structure 70 is maintained flush with the drywall surface 80. It should be noted, by referencing FIG. 9, that the housing 20 of the invention is held in the hand with the bottom of the housing 20 facing the user. The thumb is not positioned in the recesses 38 and 40 while executing the mitering cut. Alternatively, the housing 20 may be held in the hand with the top of the housing 20 facing the user.

The invention may also include a notch 86 formed in the housing 20, as shown in FIG. 2. The notch 86 is formed in a manner which exposes a portion 88 of the blade 22, shown partially in phantom. A rope, or similar material, may be positioned in the notch 86 and contacted with the exposed portion 88 of the blade 22 to effect cutting of the rope. Alternatively, the notch may be formed at the rearward end 34 of the housing 20 in a manner which exposes a portion of the spare blade retained within the housing 20.

The present invention provides safer and less encumbered means of cutting or scoring surfaces with because it provides thumb positioning structure which allows a sturdy grip on the housing. The present invention further provides angled structure for producing precision cuts thereby eliminating materials wasted by imprecise or inaccurate cuts. The cutting structure of the present invention may be useful in many applications involving cutting or scoring materials requiring accurate measurement.

The structure of the invention may be modified to meet the demands of the particular application. Hence, reference herein to specific details of the illustrated embodiments is by way of example and not by way of limitation. It will be apparent to those skilled in the art that many additions, deletions and modifications to the illustrated embodiments of the invention may be made without departing from the spirit and scope of the invention as defined by the following claims.

What is claimed is:

1. Cutting structure comprising:

a housing having elongated sides, a forward end, and a rearward end;

a blade extendable from said forward end; and thumb positioning structure associated with said elongated sides having an upstanding, flat planar surface structured to retain measurement means thereagainst, said upstanding flat planar surface being disposed at an acute angle from the longitudinal axis of said housing, and said thumb positioning structure being located from said blade a distance to prevent contact between a thumb and said blade.

2. The cutting structure of claim 1 wherein said acute angle is about sixty-degrees from said longitudinal axis.

3. The cutting structure of claim 1 wherein said forward end of said housing further includes angled structure associated therewith providing a guiding surface for executing cuts at an angle to a planar surface.

4. The cutting structure of claim 3 wherein said guiding surface is formed at a forty-five degree angle from the lateral axis of said blade.

5. The cutting structure of claim 3 wherein said blade is retractable within said housing.

6. Cutting structure comprising:

a housing having elongated sides, a forward end, and a rearward end;

a recess formed in either of said elongated sides, said recess being structured to provide a flat planar surface structured to receive the thumb of a user and an upstanding flat planar surface against which measuring structure is positionable, said upstanding flat planar surface being disposed at an acute angle from the longitudinal axis of said housing; and a blade extendable from said forward end of said housing.

7. The cutting structure of claim 6 wherein said housing further includes angled structure associated therewith providing a guiding surface for executing cuts at an angle to a planar surface.

8. The cutting structure of claim 7 further comprising measuring structure retained within said housing and positioned transverse the longitudinal axis of said housing, said measuring structure being retractable and extendable from said housing through an opening formed proximate said upstanding flat planar surface.

9. The cutting structure of claim 8 wherein said blade is slidably positioned relative to said housing and is retractable therein.

10. The cutting structure of claim 7 wherein said acute angle is sixty-degrees, and said guiding surface is formed at a forty-five degree angle from the lateral axis of said blade.

11. Cutting structure comprising:

a housing having elongated sides, a forward end, and a rearward end;

a blade extendable from said forward end; and thumb positioning structure associated with said elongated sides having an upstanding, flat planar surface structured to retain measurement means thereagainst, said upstanding flat planar surface being disposed at an acute angle from the longitudinal axis of said housing, and said thumb positioning structure being located from said blade a distance to prevent contact between a thumb and said blade;

an opening associated with said surface; and measurement means retained within said housing transverse the longitudinal axis of said housing, said measuring structure being extendible from said housing through said opening.

12. The cutting structure of claim 11 wherein said measuring structure is a tape measure.

13. The cutting structure of claim 12 wherein said tape measure is retractable within said housing.

* * * * *